US005249980A

United States Patent [19]

Hatagishi

[11] Patent Number: 5,249,980

[45] Date of Patent: Oct. 5, 1993

[54] SOLDERLESS CONNECTOR

[75] Inventor: Yuji Hatagishi, Shizuoka, Japan

[73] Assignee: Yazaki Corporation, Tokyo, Japan

[21] Appl. No.: 746,178

[22] Filed: Aug. 15, 1991

Related U.S. Application Data

[63] Continuation of Ser. No. 584,837, Sep. 19, 1990, abandoned.

[30] Foreign Application Priority Data

Oct. 30, 1989 [JP] Japan ..... 1-125608

[51] Int. Cl.[5] ..... H01R 4/24

[52] U.S. Cl. ..... 439/398; 439/751; 439/873

[58] Field of Search ..... 439/395, 396–407, 439/417–419, 744–747, 751, 870–873

[56] References Cited

U.S. PATENT DOCUMENTS

| | | | |
|---|---|---|---|
| 3,510,823 | 5/1970 | Cervenka et al. | 439/741 |
| 4,010,996 | 3/1977 | Hopkins et al. | 439/406 |
| 4,074,929 | 2/1978 | Krider | 439/398 |
| 4,277,124 | 7/1981 | Loose et al. | 439/398 |
| 4,296,988 | 10/1981 | Warner | 439/398 |
| 4,377,321 | 3/1983 | Weisenburger | 439/406 |
| 4,527,852 | 7/1985 | Dechelette | 439/398 |

*Primary Examiner*—David L. Pirlot

*Attorney, Agent, or Firm*—Sughrue, Mion, Zinn, Macpeak & Seas

[57] ABSTRACT

In a solderless connector having an insulation displacement terminal which is a plate member accommodated in a connector housing, the plate member includes a wire insulation displacement part with a slot, and has engaging protrusions before and after the wire insulation displacement part. The connector housing has engaging grooves formed in its bottom. The engaging protrusions are engaged with the engaging grooves, to prevent the longitudinal deformation of the wire insulation displacement part.

15 Claims, 4 Drawing Sheets

SOLDERLESS CONNECTOR

This is a continuation of application Ser. No. 07/584,837 filed Sep. 19, 1990.

BACKGROUND OF THE INVENTION

This invention relates to a solderless connector.

FIG. 5 is an exploded perspective view showing a conventional solderless connector 28 which has been disclosed, for instance, in Japanese Utility Model Unexamined Publication No. Sho. 60-138266, and which includes a connector housing 11, and insulation displacement terminals 12, to which electrical wires are connected. The connector housing 11 has terminal accommodating chambers 13, and a top wall 29 whose rear half has an opening 30 so that the terminal accommodating chambers 13 can be accessed. The insulation displacement terminals 12 are placed in respective ones of the terminal accommodating chambers 13, to which respective ones of the electrical wires 16 are connected by pressure, respectively.

The assembling of the solderless connector will become more apparent from FIG. 6, a perspective view showing essential components of the solderless connector. The insulation displacement terminal 12 is a female insulation displacement terminal which is formed as follows. First, a base plate 14 is formed by blanking a piece of electrically conductive metal plate, and then it is bent as follows: The front end portion of the base plate 14 is inserted into an elastic electrical contact part 15 which merges with a wire insulation displacement part 17. The wire insulation displacement part 17 is substantially inverted-U-shaped, and has a slot 17*a* into which the conductors 16*b* of the electrical wire are press-fitted with its cover 16*a* cut. The wire insulation displacement part 17 merges with the rear end portion of the insulation displacement terminal which is formed into a wire clamping part 18. A jig (not shown) is used to push the wire 16 into the wire insulation displacement part 17 from above.

The conventional solderless terminal is disadvantageous for the following reasons Where the wire is large in diameter, as shown in FIG. 7, the inverted-U-shaped wire insulation displacement part 17 is spread when pushed, as a result of which the wire is not pushed sufficiently into the slot 17*a*. At the same time, the insulation displacement terminal 12 is increased in length, to extend from the terminal accommodating chamber 13, thus causing a short-circuit. The deformation of the wire insulation displacement part 17 may be prevented by increasing the thickness of the insulation displacement terminal 12. However, then it would be necessary to increase the force of insertion of the mating terminal (or male tab terminal (not shown)) correspondingly, impairing the operability of the connector.

SUMMARY OF THE INVENTION

Accordingly, an object of this invention is to eliminate the above-described difficulties accompanying a conventional solderless connector.

More specifically, an object of the invention is to provide a solderless connector in which the insulation displacement terminal is prevented from being deformed when pushed, with the force of insertion of the mating terminal, i.e., the thickness of the insulation displacement terminal, maintained unchanged.

The foregoing and other objects of the invention have been achieved by the provision of a solderless connector having an insulation displacement terminal which is a plate member accommodated in a connector housing, the plate member including a wire insulation displacement part with a slot, in which, according to the invention, the plate member has first engaging portions formed therein so as to be located before and after the wire insulation displacement part. The connector housing has second engaging portions formed in the bottom thereof so as to be engageable with the first engaging portions, to prevent the longitudinal deformation of the wire insulation displacement part.

In the solderless connector, since engaging protrusions or holes provided before and after the wire insulation displacement part of the pressure connector are engaged with the second engaging portion formed in the bottom of the connector housing, the longitudinal movement of the insulation displacement terminal is limited, so that the insulation displacement terminal will never be deformed, even when a heavy wire is pushed into the slot of the wire insulation displacement part.

The nature, principle and utility of the invention will become more apparent from the following detailed description when read in conduction with the accompanying drawings.

DETAILED DESCRIPTION OF THE PREFERRED EMBODIMENTS

Figure 1:
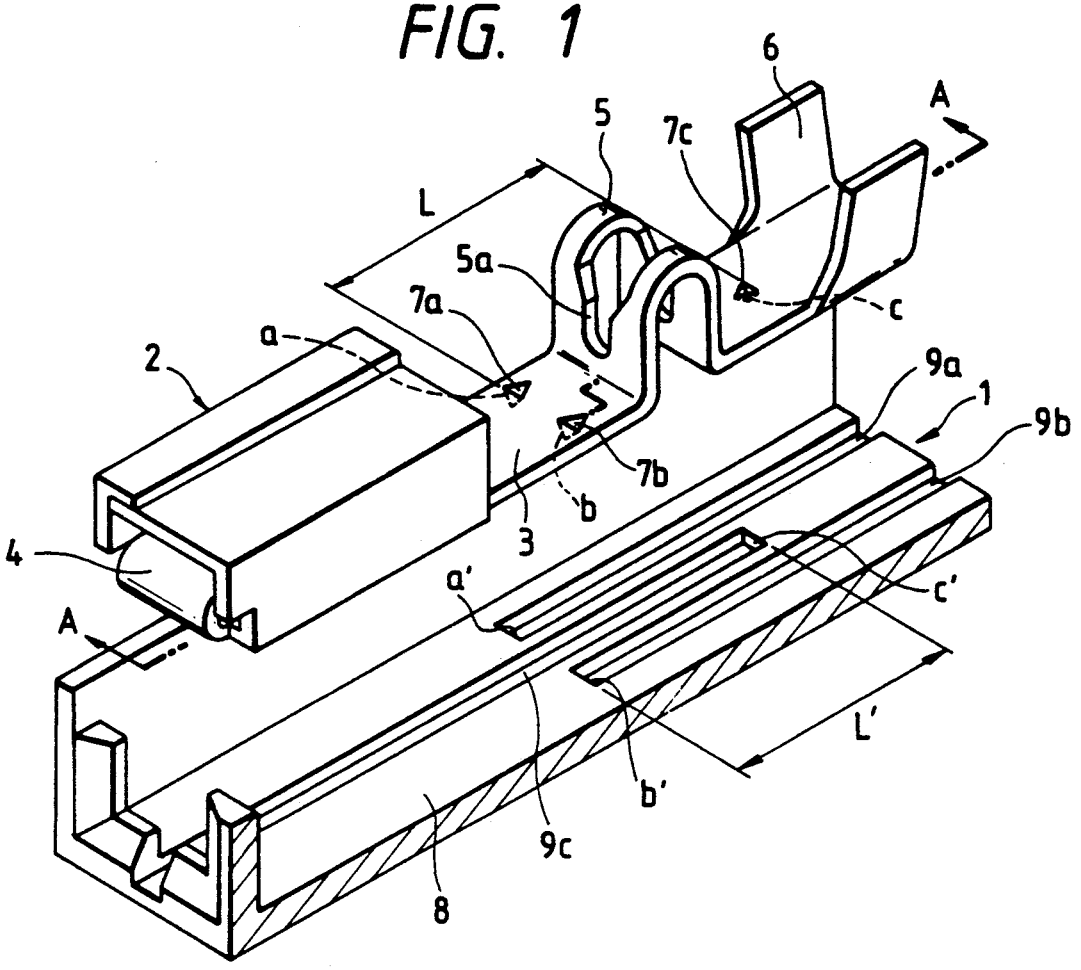
FIG. 1 exploded perspective view showing one example of a solderless connector according to this invention.

One example of a solderless connector according to this invention will be described with reference to FIG. 1, in which a female insulation displacement terminal 2 is accommodated in a connector housing 1. The female insulation displacement terminal 2 is formed as follows. As in the above-described conventional solderless connector, a base plate 3 is formed by blanking a piece of electrically conductive metal plate, and is bent as follows: The front end portion is formed into an electrical contact part 4 which merges with a substantially inverted-U-shaped wire insulation displacement part 5 having a slot 5*a*. The rear end portion of the base plate 3 is formed into a wire clamping part 6. In addition, engaging protrusions 7*a*, 7*b*, and 7*c*, substantially in the form of a triangular pyramid, are formed on the base plate 3, two before and one after the wire insulation displacement part 5, so as to protrude downwardly from the lower surface of the base plate 3.

More specifically, the engaging protrusions 7*a* and 7*b* are positioned before the wire insulation displacement part 5 so that a phantom line connecting the two protrusions 7*a* and 7*b* is perpendicular to the central axis of the base plate. The remaining protrusion 7*c* is positioned after the wire insulation displacement part 5, on the central axis. The front engaging protrusions 7*a* and 7*b* have their vertical end faces a and b facing forward, while the remaining rear engaging protrusion 7*c* has its vertical end face c facing backward.

Three engaging grooves 9*a*, 9*b*, and 9*c* are formed in the bottom wall 8 of each of the terminal accommodating chambers of the connector housing 1 so that they are engageable with the above-described engaging protrusions 7*a*, 7*b*, and 7*c*, respectively.

The engaging grooves 9*a*, 9*b*, and 9*c* have end walls a', b' and c' which abut the vertical end faces a, b, and c of the engaging protrusions 7*a*, 7*b*, and 7*c*, respectively. The distance L' between the end walls a, and b' and the end wall c' is equal to or slightly longer than the distance L between the end faces a and b of the front engaging protrusions 7*a* and 7*b* and the end face c of the rear engaging protrusion 7*c*.

Figure 2:
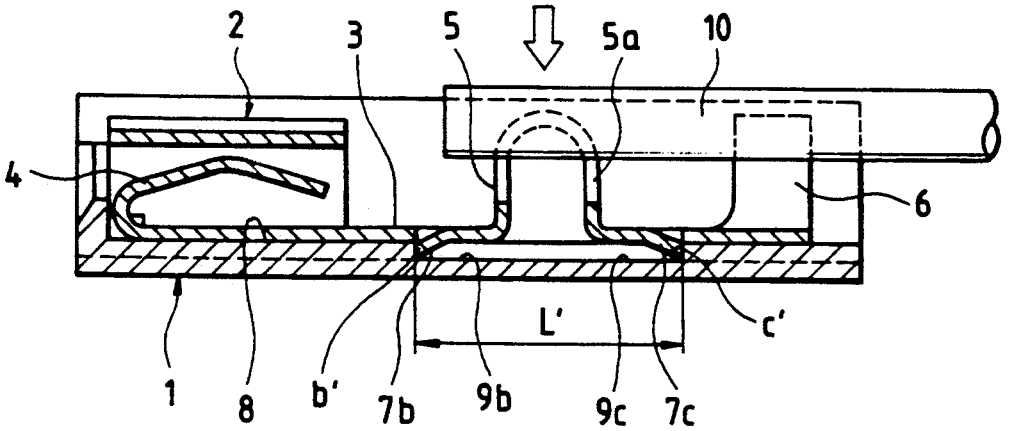
FIG. 2 is a sectional view taken along line A—A in FIG. 1.

As shown in FIG. 2, the insulation displacement terminal 2 is set in the terminal accommodating chamber with its engaging protrusions 7*a*, 7*b*, and 7*c* engaged with the engaging grooves 9*a*, 9*b*, and 9*c* of the connector housing 1, and the wire 10 is pushed into the slot 5*a* of the wire insulation displacement part 5 of the insulation displacement terminal 2 from above (in the direction of the arrow).

As was described above, the engaging protrusions 7*a*, 7*b*, and 7*c* formed before and after the wire insulation displacement part 5 are engaged with the engaging grooves 9*a*, 9*b* and 9*c*, and abut the end walls a', b', and c' of the respective engaging grooves 9*a*, 9*b*, and 9*c*. Hence, when the wire is pushed into the slot 5*a* of the wire insulation displacement part 5, the part 5 will not spread longitudinally of the insulation displacement terminal 2.

Hence, where the insulation displacement terminal 2 is made of a thin metal plate in order to reduce the terminal inserting force, a large-diameter wire can be connected with ease. In addition, the rear engaging protrusion 7*c* can prevent the insulation displacement terminal from being moved backwardly; that is, it prevents the insulation displacement terminal from coming off the wire accommodating chamber when pulled backwardly.

In the above-described solderless connector, the engaging protrusions 7*a* through 7*c* are formed on the insulation displacement terminal 2, while the engaging grooves 9*a* through 9*c* for engaging with the engaging protrusions 7*a* through 7*c* are formed in the connector housing 1; however, the invention is not so limited. That is, the engaging protrusions may be formed on the connector housing, with the engaging grooves for engaging with the engaging protrusions formed in the insulation displacement terminal 2. Furthermore, in the above-described solderless connector, the insulation displacement terminal 2 is a female insulation displacement terminal; however, it goes without saying that the technical concept of the invention may be applied to a solderless connector with male tab terminals with the same effects.

Figure 3:
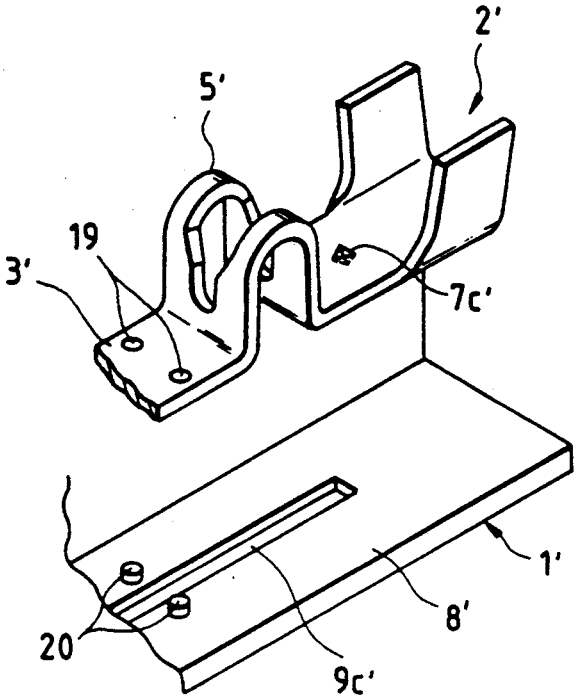
FIGS. 3*a*, 3*b* and 3*c* are an exploded perspective view showing essential components of one modification of the solderless connector illustrated in FIG. 1.

The above-described solderless connector may be modified as shown in FIGS. 3*a*, 3*b*, and 3*c*. That is, engaging holes 19 and 19 are formed in the base plate 3, before the wire insulation displacement part 5', and an engaging protrusion 7*c*' is formed on the base plate 3, after the wire insulation displacement part 5, Engaging protrusions 20 and 20 for engaging with the engaging holes 19 and 19 and an engaging groove 9*c*' for engaging with the engaging protrusion 7*c* are formed. In contrast, the engaging protrusion and the engaging holes may be positioned respectively before and after the wire insulation displacement part 5'.

Figure 4:
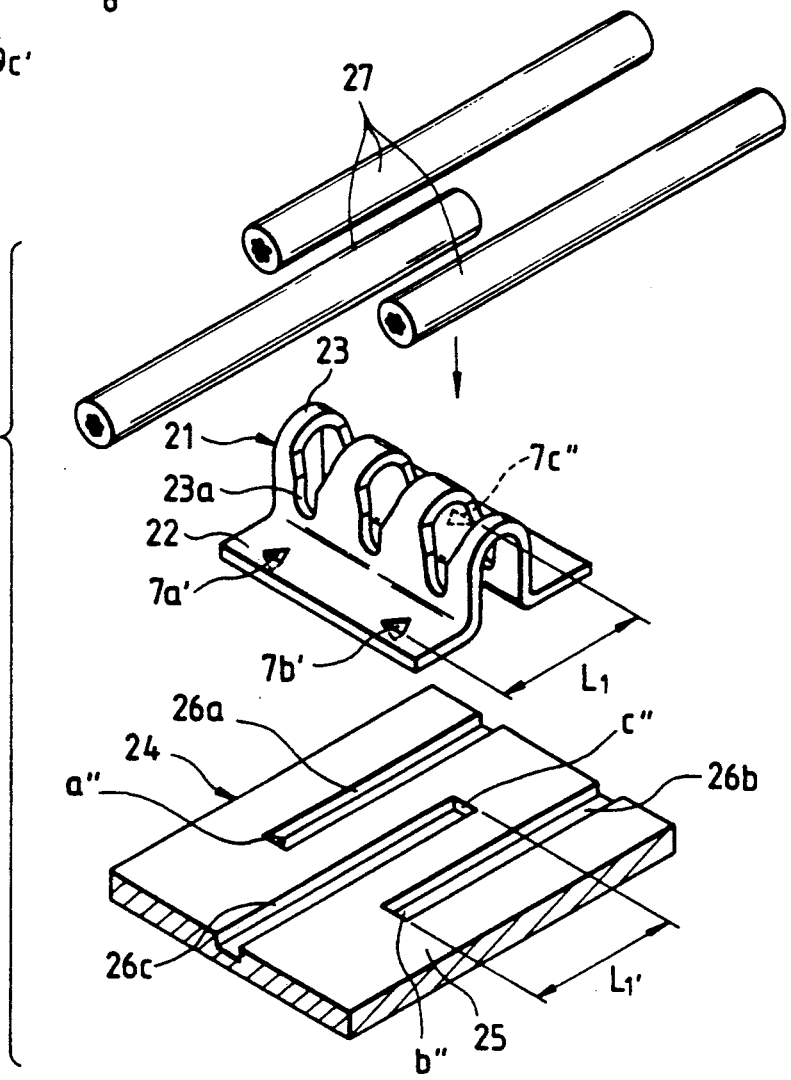
FIG. 4 is an exploded perspective view showing another example of the solderless connector according to the invention.
Figure 5:
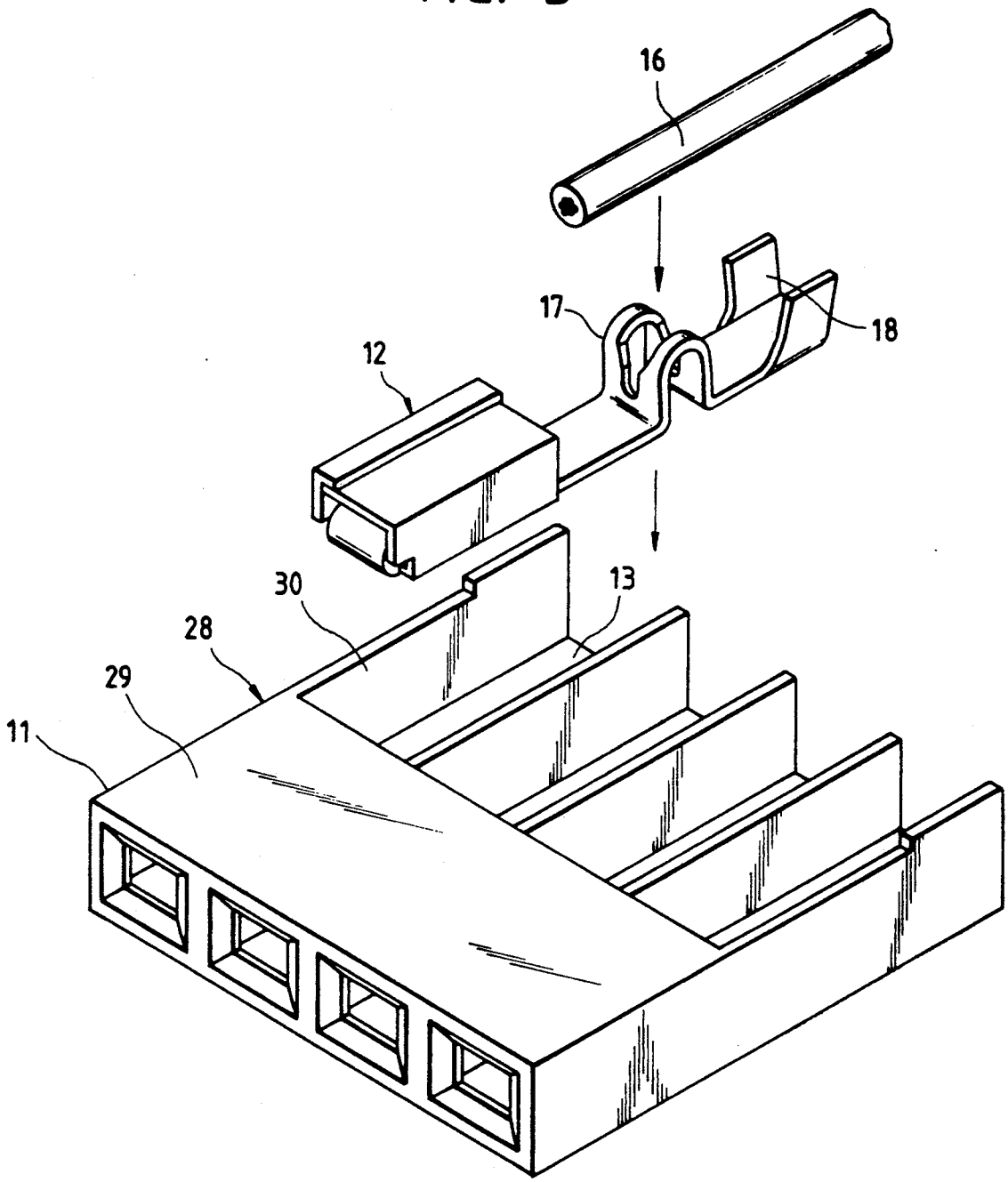
FIG. 5 is an exploded perspective view showing a conventional solderless connector.
Figure 6:
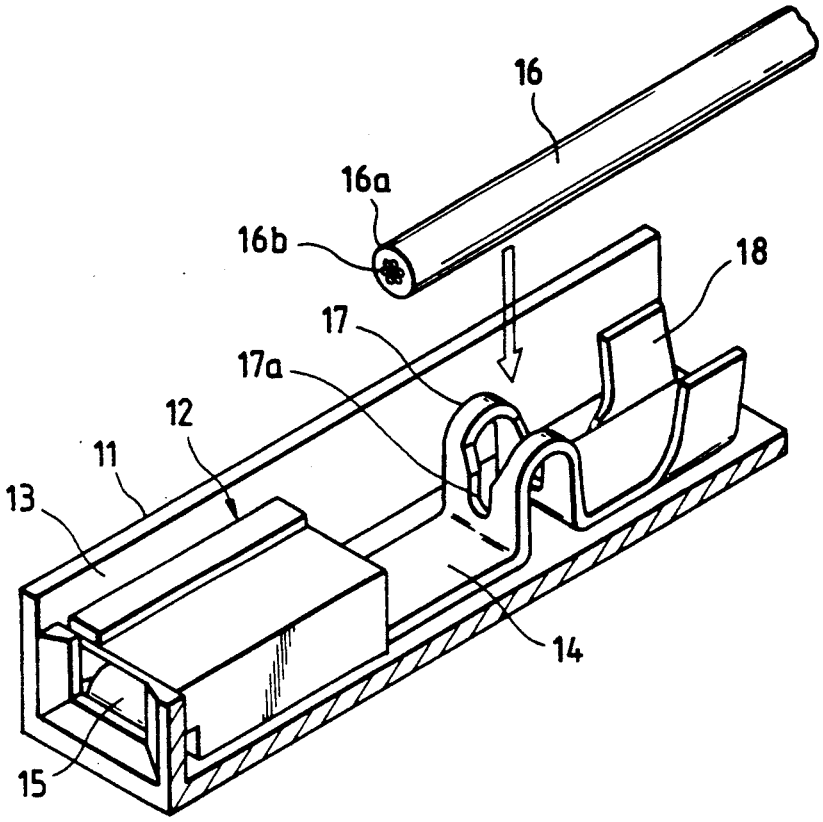
FIG. 6 is a perspective view showing essential components of the conventional solderless connector.
Figure 7:
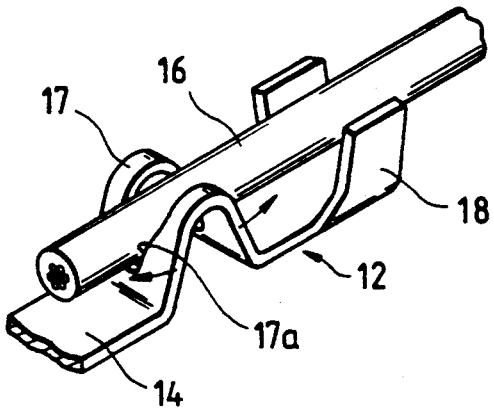
FIG. 7 is a perspective view showing the insulation displacement terminal connected to a wire in the conventional solderless connector.

Another example of the solderless connector according to the invention will be described with reference to FIG. 4. The solderless connector comprises a branch connection type insulation displacement terminal 21. The insulation displacement terminal 21 is formed as follows: A rectangular base plate 22 is bent to have a substantially inverted-U-shaped wire pressure connecting part 23 having a plurality of cover cutting slots 23*a*. The base plate 22 has two engaging protrusions 7*a* and 7*b*, before the wire pressure connecting part 23 in such a manner that the phantom line connecting the two engaging protrusions 7*a*, and 7*b*, is perpendicular to the central axis of the base plate, and one engaging protrusion 7*c*" after the wire insulation displacement part 23 on the central axis of the base plate. These engaging protrusions 7*a*', 7*b*' and 7*c*" protrude from the lower surface of the base plate 22 so as to engage three engaging grooves 26*a*, 26*b* and 26*c* formed in the bottom of each of the terminal accommodating chambers in the connector housing 24, respectively.

The distance between the end walls a" and b" of the engaging grooves 26*a* and 26*b* and the end wall c" of the engaging groove 26*c* is equal to the distance between the front protrusions 7*a* and 7*b*, and the rear protrusion 7*c*". In pushing the wire 27 into the slot 23*a* of the wire insulation displacement part 23 of the insulation displacement terminal 21, the engaging protrusions 7*a*', 7*b*', and 7*c*" engage with the end walls a", b", and c" of the engaging grooves 26*a*, 26*b*, and 26*c*, respectively, to prevent the longitudinal spreading of the wire insulation displacement part 23.

As is apparent from the above description, with the inventive solderless connector, when a wire is pushed into the slot of the insulation displacement terminal, the insulation displacement terminal is not deformed, although the insulation displacement terminal does not have increased wall thickness, even when a relatively great wire inserting force is applied. Thus, the wire can be connected to the solderless connector with high reliability, and can be connected with the mating connector with high efficiency. In addition, the insulation displacement terminal is prevented from coming off the connector housing even when pulled backwardly.

While the invention has been described in detail above with reference to preferred embodiments, various modifications within the scope and spirit of the invention will be apparent to people of working skill in this technological field. Thus, the invention should be considered as limited only by the scope of the appended claims.

What is claimed is:

1. A solderless connector comprising a connector housing an an insulation displacement terminal which is formed by bending a base plate so that said insulation displacement terminal comprises an inverted U-shaped wire insulation displacement part having a slot, an electrical contact at the forward end of said base plate, and a wire clamping part at the rearward end of said base plate, said insulation displacement terminal adaptable to reside in said connector housing, wherein said insulation displacement terminal comprises first engaging means formed on said base plate and located before and after said wire insulation displacement part, and said connector housing comprises second engaging means formed in the bottom thereof and being in interlocking engagement with said first engaging means for preventing longitudinal deformation of said wire insulation displacement part relative to said connector housing due to a biasing force of said inverted U-shaped insulation displacement part exerted when a wire is being inserted into said insulation displacement part.

2. A solderless connector as claimed in claim 1, wherein said first engaging means comprise engaging protrusions.

3. A solderless connector as claimed in claim 1, wherein said first engaging means comprise engaging holes.

4. A solderless connector as claimed in claim 1, wherein said second engaging means comprise engaging protrusions.

5. A solderless connector as claimed in claim 1, wherein said second engaging means comprise engaging grooves.

6. A solderless connector as claimed in claim 1, wherein said second engaging means comprise engaging recesses.

7. A solderless connector as claimed in claim 1, wherein said second engaging means rigidly engage said first engaging means.

8. A solderless connector comprising a connector housing and a branch connection type insulation displacement terminal which is formed by bending a base plate so that said branch connection type insulation displacement terminal comprises a plurality of inverted U-shaped wire insulation displacement parts each having a slot, said branch connection type insulation displacement terminal residing in said connector housing, wherein said branch connection type insulation displacement terminal comprises first engaging means formed on said base plate and located before and after said plurality of wire insulation displacement parts, and said connector housing comprises second engaging means formed in the bottom thereof and being in interlocking engagement with said first engaging means, for preventing the longitudinal deformation of said wire insulation displacement part when a wire is inserted into each of said wire insulation displacement parts.

9. A solderless connector as claimed in claim 8, wherein said first engaging means comprise engaging protrusions.

10. A solderless connector as claimed in claim 8, wherein said first engaging means comprise engaging holes.

11. A solderless connector as claimed in claim 8, wherein said second engaging means comprise engaging protrusions.

12. A solderless connector as claimed in claim 8, wherein said second engaging means comprise engaging grooves.

13. A solderless connector as claimed in claim 8, wherein said second engaging means comprise engaging recesses.

14. A solderless connector as claimed in claim 8, wherein said second engaging means rigidly engage said first engaging means.

15. A solderless connector comprising a connector housing and an insulation displacement terminal which is formed by bending a base plate so that said insulation displacement terminal comprises an inverted U-shaped wire insulation displacement part having a slot, an electrical contact at the forward end of said base plate, an electrical contact at the forward end of said base plate, and a wire clamping part at the rearward end of said base plate, said insulation displacement terminal adaptable to reside in said connector housing, wherein said insulation displacement terminal comprises first engaging means formed on said base plate and located before and after said wire insulation displacement part, and said connector housing comprises second engaging means formed in the bottom thereof and being in interlocking engagement with said first engaging means for preventing longitudinal deformation of said wire insulation displacement part relative to said connector housing, wherein a biasing force of said inverted U-shaped insulation displacement part is utilized to retain said second engaging means in interlocking engagement with said first engaging means.

* * * * *